US007551049B2

(12) United States Patent
Hirabayashi et al.

(10) Patent No.: US 7,551,049 B2
(45) Date of Patent: Jun. 23, 2009

(54) STRUCTURE OF ELECTROMAGNETIC SWITCH FOR STARTER

(75) Inventors: Takashi Hirabayashi, Chita-gun (JP); Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 408 days.

(21) Appl. No.: 11/266,370

(22) Filed: Nov. 4, 2005

(65) Prior Publication Data

US 2006/0109070 A1 May 25, 2006

(30) Foreign Application Priority Data

| | | |
|---|---|---|
| Nov. 8, 2004 | (JP) | 2004-324189 |
| Nov. 8, 2004 | (JP) | 2004-324212 |
| Dec. 16, 2004 | (JP) | 2004-364584 |
| Dec. 17, 2004 | (JP) | 2004-366398 |

(51) Int. Cl.
*H01H 67/02* (2006.01)

(52) U.S. Cl. ..... 335/106; 335/126; 335/131; 335/133; 335/185; 335/193; 335/263; 335/271; 335/277

(58) Field of Classification Search ..... 335/131–133, 335/193, 263, 270, 271, 277, 106, 126, 185
See application file for complete search history.

(56) References Cited

U.S. PATENT DOCUMENTS

| | | | | |
|---|---|---|---|---|
| 2,519,855 A | | 8/1950 | Schleicher | |
| 5,481,236 A | * | 1/1996 | Ruehle et al. | 335/126 |
| 5,621,249 A | | 4/1997 | Shiga et al. | |
| 5,767,585 A | | 6/1998 | Shiga et al. | |
| 5,777,393 A | | 7/1998 | Katoh et al. | |
| 5,789,821 A | | 8/1998 | Shiga et al. | |
| 6,113,058 A | | 9/2000 | Iwasaki | |

FOREIGN PATENT DOCUMENTS

| | | |
|---|---|---|
| JP | A-54-127943 | 9/1979 |
| JP | A-55-5407 | 1/1980 |
| JP | A-55-5409 | 1/1980 |
| JP | A-57-143651 | 9/1982 |

(Continued)

OTHER PUBLICATIONS

Translated Sep. 2, 2008 Office Action from related Japanese Application No. 2004-324212.

(Continued)

*Primary Examiner*—Ramon M Barrera
(74) *Attorney, Agent, or Firm*—Oliff & Berridge, PLC

(57) ABSTRACT

An electromagnetic switch for use in actuating a starter for automotive vehicles is provided. The switch includes fixed contacts, a moving contact, and a plunger shaft. The moving contact is joined to a plunger shaft through an insulator. The plunger shaft is to be moved magnetically to bring the moving contact into abutment with the fixed contact to establish electric communication between the fixed contact. The switch also includes a rotation holder working to hold the moving contact and the insulator from rotating relative to each other. Use of the rotation holder results in a decrease in wear of the insulator. This eliminates the need for the insulator to have an additional thickness which would be worn down, thus permitting the insulator to be reduced in thickness to shorten the overall length of the switch.

5 Claims, 10 Drawing Sheets

FOREIGN PATENT DOCUMENTS

| | | |
|---|---|---|
| JP | U-58-88752 | 6/1983 |
| JP | A-63-186962 | 8/1988 |
| JP | U-63-167640 | 11/1988 |
| JP | A 3-969 | 1/1991 |
| JP | A-5-25066 | 4/1993 |
| JP | A-6-507517 | 8/1994 |
| JP | A-7-122146 | 5/1995 |
| JP | A-9-126104 | 5/1997 |
| JP | A-9-257072 | 9/1997 |
| JP | A-10-154440 | 6/1998 |
| JP | A-10-299805 | 11/1998 |
| JP | A-11-153073 | 6/1999 |
| JP | A-2000-65209 | 3/2000 |
| JP | B2 3152248 | 1/2001 |
| JP | A 2003-184710 | 7/2003 |
| WO | WO 00/26533 | 5/2000 |

OTHER PUBLICATIONS

English language translation of foreign Office Action for Japanese Patent Application No. 2004-324189, Jan. 6, 2009.

English translation of Notification of Reasons for Rejection, Japanese Patent Application No. 2004-366398, Jan. 27, 2009.

English translation of Notification of Reasons for Rejection, Japanese Patent Application No. 2004-364584, Jan. 27, 2009.

* cited by examiner

STRUCTURE OF ELECTROMAGNETIC SWITCH FOR STARTER

CROSS REFERENCE TO RELATED DOCUMENT

The present application claims the benefits of Japanese Patent Application Nos. 2004-324189, 2004-324212, 2004-364584, and 2004-366398 filed on Nov. 8, 2004, Nov. 8, 2004, Dec. 16, 2004, and Dec. 17, 2004, respectively, disclosures of which are totally incorporated herein by reference.

BACKGROUND OF THE INVENTION

1. Technical Field of the Invention

The present invention relates generally to an electromagnetic switch for use in opening or closing contacts of a motor driver for automotive engine starters.

2. Background Art

There are known electromagnetic switches for use in a motor driver for engine starters. For instance, Japanese Patent First Publication No. 3-969 discloses an electromagnetic switch which includes a pair of fixed contacts to be joined to a motor driver and a moving contact retained on an end of a plunger shaft through an insulator. The moving contact is brought by the plunger shaft into abutment with the fixed contacts to establish electric communication between the fixed contacts to actuate the motor driver.

The above switch has the moving contact installed to be rotatable relative to the insulator and, thus, encounters the drawback in that relative rotation between the moving contact and the insulator due to mechanical vibrations of the switch will result in wear of the insulator, thus requiring the need for increasing the size of the insulator enough to compensate for such wear, which leads to an increased overall length of the switch.

When the moving contact abuts the fixed contacts, it will produce a physical impact on the insulator. It is, thus, necessary for the insulator to have the mechanical strength great enough to withstand such impact. Particularly, in a case where the insulator is made of resin, it will be essential to design the strength of a weld in the insulator which usually occurs during molding thereof and is weaker in mechanical strength than a remaining part of the insulator. Specifically, it is necessary for the weld to have the strength greater enough to withstand a maximum load exerted by the moving contact on the insulator. This requires increasing the thickness of the insulator, thus resulting in an increased overall length of the switch.

International Publication No. WO 00/26533, Japanese Patent No. 3152248, and Japanese Patent First Publication No. 2003-184710 disclose the above type of electromagnetic switch.

SUMMARY OF THE INVENTION

It is therefore a principal object of the invention to avoid the disadvantages of the prior art.

It is another object of the invention to provide an improved structure of an electromagnetic switch for a starter which is designed to have a greater mechanical strength and a small size.

It is a further object of the invention to provide an electromagnetic switch for a starter which is constructed to be compact in size without sacrificing the mechanical strength thereof.

According to one aspect of the invention, there is provided an electromagnetic switch which may be employed in actuating a starter for automotive engines. The electromagnetic switch comprises: (a) a plunger to be attracted through electromagnetic force; (b) fixed contacts to be joined to a motor circuit of a starter; (c) a moving contact working to establish electric communication between the fixed contacts; (d) a plunger shaft which retains the moving contact through an insulator, the plunger working to move the moving contact following magnetic attraction of the plunger to bring the moving contact into abutment with the fixed contacts to establish the electric communication therebetween; and (e) a rotation holder disposed between the moving contact and the insulator. The rotation holder works to hold the moving contact and the insulator from rotating relative to each other.

Use of the rotation holder results in a decrease in wear of the insulator. This eliminates the need for the insulator to have an additional thickness which would be worn down, thus permitting the insulator to be reduced in thickness to shorten the overall length of the switch.

In the preferred mode of the invention, the moving contact is so retained that the moving contact hits at substantially the same areas thereof with the fixed contacts. The insulator is made of a resin mold in which a weld is formed in a location other than a portion of the insulator on which a maximum impact load acts when the plunger is magnetically attracted to bring the moving contact into abutment with the fixed contacts.

The weld may be formed in the portion of the insulator on which a minimum impact load acts when the plunger is magnetically attracted to bring the moving contact into abutment with the fixed contacts.

The switch also includes a contact cover which covers the fixed contacts and the moving contact. The moving contact is held at an outer periphery thereof by an inner wall of the contact cover from rotating and movable in an axial direction of the contact cover.

The rotation holder may be made up of a recess formed in the moving contact and a protrusion formed on the insulator which is fitted in the recess to hold the moving contact and the insulator from rotating relative to each other. The weld may be formed so as to appear in the protrusion.

According to the second aspect of the invention, there is provided an electromagnetic switch for a starter which comprises; (a) a core working to form a portion of a magnetic circuit; (b) a plunger disposed to undergo an magnetic attraction in a first direction toward the core; (c) a pair of fixed contacts to be joined to a motor circuit of a starter; (d) a shaft secured to the plunger; (e) a moving contact installed on an end of the shaft through an insulator, the moving contact being moved in the first direction following the attraction acting on the plunger against the spring pressure produced by the spring to establish an electric communication between the fixed contacts in a switch closed position; (f) a spring disposed between the core and the plunger to produce a spring pressure which urges the plunger in a second direction opposite the first direction away from the core to keep the plunger in a switch open position; and (g) a recess formed in an end surface of the core opposite the plunger to have a hitting face on a bottom of the recess on which an end of the insulator hits when the plunger is returned by the spring pressure of the spring from the switch closed position to the switch open position.

Specifically, when the insulator is brought into abutment with the hitting face of the core, the insulator partially overlaps the core in the radius direction of the switch, that is, the insulator partially enters the core. This structure permits the insulator to be increased in thickness without the need for increasing the overall length of the switch. The increasing of the thickness t of the insulator results in an increased mechanical strength of the insulator.

In the preferred mode of the invention, the recess has a depth that is a distance between the hitting face and the end face of the core. The depth is smaller than a thickness of the insulator.

The plunger is disposed within a yoke through a first clearance between an outer periphery of the plunger and an inner wall of the yoke. The insulator is to be disposed within the recess through a second clearance between an outer periphery of the insulator and an inner periphery of the recess. The second clearance is greater than the first clearance. This prevents the insulator from riding on the end face of the score when the plunger is shifted or inclined in the radius direction, thus ensuring the stability in returning the plunger away from the core.

According to the third aspect of the invention, there is provided an electromagnetic switch for a starter which comprises: (a) a core working to form a portion of a magnetic circuit; (b) a plunger disposed to undergo an magnetic attraction in a first direction toward the core; (c) a pair of fixed contacts to be joined to a motor circuit of a starter; (d) a shaft secured to the plunger, (e) a moving contact installed on an end of the shaft through an insulator, the moving contact being moved in the first direction following the attraction acting on the plunger against the spring pressure produced by the spring to establish an electric communication between the fixed contacts in a switch closed position; (f) a spring disposed between the core and the plunger to produce a spring pressure which urges the plunger in a second direction opposite the first direction away from the core to keep the plunger in a switch open position; (g) a recess formed in an end surface of the core opposite the plunger to have a hitting face formed on an inner surface of the recess, hitting face tapering from the end surface; and (h) a tapered stopper face formed on the insulator which is fitted on the hitting face of the recess to stop movement of the plunger when the plunger is returned by the spring pressure of the spring from the switch closed position to the switch open position.

When the plunger is returned away from the core by the activity of the spring, the tapered stopper face of the insulator is fitted on the tapered hitting face of the core, so that insulator partially overlaps the core in the radius direction of the switch, that is, the insulator partially enters the core. This structure permits the insulator to be increased in thickness without the need for increasing the overall length of the switch. The increasing of the thickness of the insulator results in an increased mechanical strength of the insulator.

The engagement of the tapered stopper face of the insulator with the tapered hitting face of the core increases the accuracy in centering the shaft, thereby ensuring the stability in assembling the switch in the starter. The engagement also minimizes the inclination or deflection of the insulator to avoid exertion of a undesirable biasing force on the insulator, thus permitting the mechanical strength of the insulator to be selected to be minimum. This allows the insulator to be made of an inexpensive material.

In the preferred mode of the invention, when the stopper face is placed in abutment with the hitting face, a gap is established between the core and the moving contact.

According to the fourth aspect of the invention, there is provided an electromagnetic switch for a starter which comprises: (a) a hollow cylindrical switch body having disposed therein a core which extends in a radius direction of the switch body and forms a portion of a magnetic circuit; (b) a contact cover jointed at an end thereof to an end of the switch body, the contact cover having defined therein a chamber within which a moving contact is disposed which is to be magnetically moved by the switch body into abutment with or away from fixed contacts; and (c) a seal ring disposed between the end of the contact cover and an end face of the core. The end of the contact cover has formed therein an annular outside face and an inside end face. The annular outside face extends outside the chamber and compresses thickness of the seal ring against an outer portion of the end face of the core. The inside end face extends inwardly of the annular outside face without compressing the thickness of the seal ring. The seal ring includes an annular outside thick wall and an inside thin wall. The annular outside thick wall is disposed in a nip formed by the annular outside face of the contact cover and the end face of the core. The inside thin wall extends inwardly of the annular outside thick wall between the inside end face of the contact cover and the end face of the core.

When the contact cover is joined to the switch body, the inside thin wall of the seal ring is disposed between the inside end face of the contact cover and the end face of the core. The inside thin wall is smaller in thickness than the outside thick wall, so that the thickness thereof is compressed to a smaller extent than the outside thick wall upon the joining of the contact cover to the switch body. This permits the degree of pressure, which is required to press the contact cover against the core when the contact cover is joined firmly to the switch body, to be reduced without sacrificing the ability of sealing of the seal ring. The inside thin wall may be made of packing sheets connecting with the annular outside thick wall, thus minimizing undesirable deformation of the seal ring when installed in the switch body to facilitate the ease of the installation thereof.

In the preferred mode of the invention, the outside thick wall of the seal ring includes an annular outer portion and a plurality of inner portions extending inwardly fm the annular outer portion. The inside thin wall is made up of a plurality of sections connecting with the inner portions of the outside thick wall.

The inside thin wall defines along with the inner portions of the annular outside thick wall a window which faces the chamber of the contact cover.

The inside thin wall of the seal ring may have opposed surfaces recessed from the annular outside thick wall by the same depth.

The seal ring has formed therein terminal holes through which leads extend to supply electricity to an exciting coil provided in the switch body and positioning holes through which portions of the end of the contact cover are placed in abutment with the end face of the core. The annular outside thick wall extends to surround the terminal holes and the positioning holes.

According to the fifth aspect of the invention, there is provided an electromagnetic switch for a starter which comprises: (a) a hollow cylindrical switch body having disposed therein a core which extends in a radius direction of the switch body and forms a portion of a magnetic circuit; (b) a contact cover jointed at an end thereof to an end of the switch body, the contact cover having defined therein a chamber within which a moving contact is disposed which is to be magnetically moved by the switch body into abutment with or away from fixed contacts; and (c) a seal ring disposed between the end of the contact cover and an end face of the core. The end of the contact cover has formed therein an annular outside face and an inside end face. The annular outside face extends outside the chamber and compresses a thickness of the seal ring against an outer portion of the end face of the core. The inside end face extends inwardly of the annular outside face without compressing the thickness of the seal ring and being recessed from the annular outside face. The seal ring is held between the annular outside face of the contact cover and the end face of the core and between the inside end face of the contact cover and the end face of the core.

According to the sixth aspect of the invention, there is provided an electromagnetic switch for a starter which comprises: (a) a switch body; (b) a contact cover joined to the switch body, the contact cover having a contact chamber formed therein; (c) a plunger shaft disposed within the switch body to have an end portion exposed to the contact chamber of the contact cover, the plunger shaft being magnetically movable in an axial direction thereof; (d) a moving contact retained on an end of the plunger shaft, the moving contact extending in a radius direction of the plunger shaft; (e) a first and a second fixed contact bar member extending through the contact cover in the axial direction the plunger shaft to have a first and a second head exposed inside the contact chamber of the contact cover, the first and second heads having a first and a second fixed contact facing a surface of the moving contact for making an electric contact between the first and second fixed contacts when the surface of the moving contact is brought by movement of the plunger shaft into abutment with the first and second fixed contacts; and (f) a first and a second protrusions formed on the first and second heads of the first and second fixed contact bar members to define the first and second fixed contacts, respectively.

Specifically, the fixed contact bar members have the protrusions or fixed contacts biased toward the axis of the plunger shaft, thus permitting the length of the moving contact to be decreased and ensuring the contacts of the entire surfaces of the fixed contacts with the moving contact without need for decreasing the interval between the fixed contact bar members.

In the preferred mode of the invention, the first and second heads of the first and second fixed contact bar members are located at an interval away from each other which allows a portion of the plunger shaft extending from the moving contact toward the first and second fixed contact bar members to enter between the first and second fixed contacts without any physical contact therewith.

The first and second heads of the first and second fixed contact bar members are arrayed across an imaginary line extending in alignment with a longitudinal center line of the plunger shaft. The centers of the first and second contacts are located closer to the imaginary line than centers of the first and second heads.

The first and second contacts are located closer to the imaginary line in a direction perpendicular to the imaginary line than longitudinal center lines of major bodies of the first and second fixed contact bar member other than the first and second heads.

A maximum distance between a longitudinal center line of the plunger shaft and an outermost end of the moving contact in a radius direction of the plunger shaft is substantially equal to or greater than a maximum distance between the imaginary line and an outermost end of at least one of the first and second fixed contacts in the radius direction of the plunger shaft.

Areas of the first and second fixed contacts and areas of the moving contact, which are to abut each other to make the electric contact between the first and second fixed contacts, are of a rectangular shape defined by a first pair of sides extending substantially parallel to a line passing through the first and second fixed contact bar members in a radius direction of the plunger shaft and a second pair of sides extending substantially perpendicular to the first pair of sides.

A initial thickness of each of the first and second protrusions in the axial direction of the plunger shaft is greater than a distance by which the moving contact is permitted to advance in the axial direction of the plunger shaft due to wear of the first and second fixed contacts from an initial position where the moving contact is in abutment with the first and second fixed contacts.

An area of each of the first and second heads of the first and second fixed contact bar members other than an area on which a corresponding one of the first and second protrusions is formed may have an uneven surface.

A major body of each of the first and second fixed contact bar members may be lower in thermal conductivity than the first and second protrusions.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a front view of FIG. 2(*a*);

FIG. 3(*b*) is a front view of FIG. 3(*a*);

FIG. 4(*b*) is a front view of FIG. 4(*a*);

FIG. 9(*b*) is a longitudinal sectional view of FIG. 9(*a*);

FIG. 13(*b*) is a longitudinal sectional view of FIG. 13(*a*);

FIG. 14(*b*) is a side view of FIG. 14(*a*); and

DESCRIPTION OF THE PREFERRED EMBODIMENTS

Figure 1:
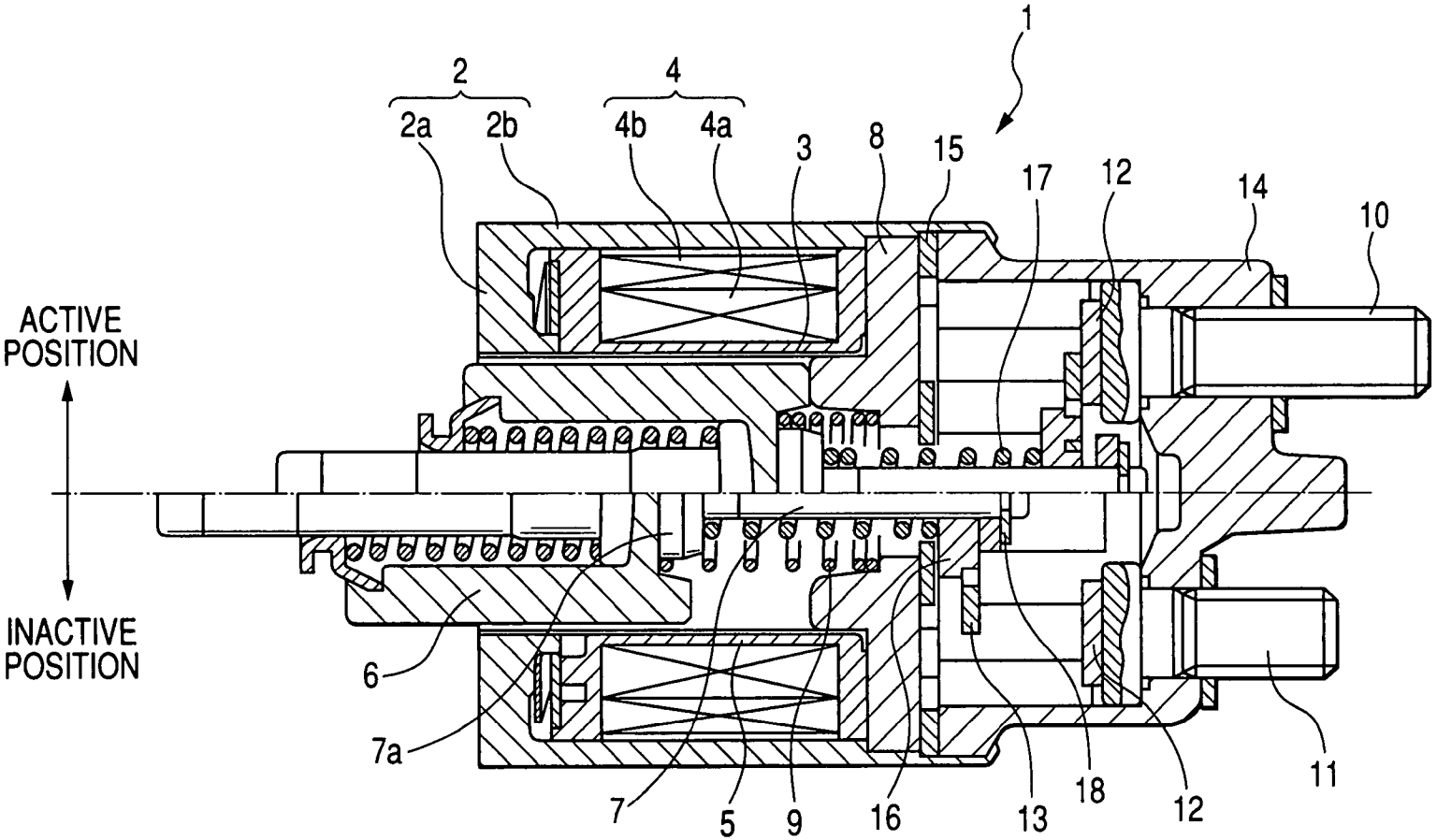
FIG. 1 is a longitudinal sectional view which shows an electromagnetic switch for a starter according to the first embodiment of the invention.

Referring now to the drawings, wherein like reference numbers refer to like parts in several views, particularly to FIG. 1, there is provided an electromagnetic switch 1 according to the first embodiment of the invention which is used in actuating a starter for automotive engines, for example.

The electromagnetic switch 1 includes a cup-shaped yoke 2, an exciting coil 4, a plunger 6, a plunger shaft 7, and a motor contact assembly (will be described later in detail). The exciting coil 4 is wound round a bobbin 3 and disposed inside the yoke 2. The plunger 6 is disposed inside the bobbin 3 through a sleeve 5. The plunger shaft 7 is fixed to the plunger 6. The motor contact assembly works to open or close a motor circuit (i.e., a motor driver) of a starter.

The yoke 2 is made up of a bottom wall 2*a* and a cylindrical peripheral wall 2*b*. The bottom wall 2*a* has a circular center opening formed therein. The peripheral wall 2*b* extends from the circumference of the bottom wall 2*a* to cover the exciting coil 4. The yoke 2 also serves as an outer shell or a main body of the electromagnetic switch 1 and also makes a magnetic circuit around the exciting coil 4 along with a stationary core 8.

The exciting coil 4 is made up of an attracting coil 4*a* and a holding coil 4*b* which are wound around the bobbin 3 in a two-layer form. The attracting coil 4*a* works to produce a magnetic attraction to draw the plunger 6. The holding coil 4*b* works to hold the plunger, as drawn by the attracting coil 4*a*, from moving.

The sleeve 5 is made of, for example, a cylindrical stainless steel and extends from inside the bobbin 3 to inside the circular opening of the bottom wall 2*a* of the yoke 2.

The plunger 6 is disposed inside the sleeve 5 so that it may be slidable in an axial direction of the sleeve 5 in contact with an inner wall of the sleeve 5. The plunger 6 is urged by a return spring 9 in a left direction, as viewed in the drawing, away from the stationary core 8. The return spring 9 is disposed between the plunger 6 and the stationary core 8.

When the stationary core 8 is magnetized by energizing the exciting coil 4, it will cause the plunger 6 to be moved in a right direction, as viewed in the drawing, by magnetic attraction produced by the exciting coil 4 to compress the return spring 9. Alternatively, when the exciting coil 4 is deenergized, so that the magnetic attraction disappears, it will cause the plunger 6 to be returned back in the left direction by the spring pressure of the return spring 9. In FIG. 1, an upper side above the longitudinal center line of the switch 1 illustrates for the case where the switch 1 is in an activated state or a closed position. A lower side beneath the longitudinal center line illustrates for the case where the switch is in an inactivated state or an open position.

The plunger shaft 7 has formed on an end thereof a flange 7*a* which is welded at an end surface thereof to the plunger 6 so that they may be rotatable together.

The motor contact assembly includes a pair of fixed contacts 12 connected to the motor circuit through two terminal bolts 10 and 11 and a moving contact 13 facing the fixed contacts 12. When it is required to close the motor contact assembly, the moving contact 13 is moved to electrically connect between the fixed contacts 12. Alternatively, when it is required to open the motor contact assembly, the moving contact 13 is returned back from the fixed contacts 12 to disconnect them.

The terminal bolts 10 and 11 are installed fixedly in a resinous contact cover 14. The fixed contacts 12 are disposed inside the contact cover 14 and affixed to heads of the terminal bolts 10 and 11, respectively. The contact cover 14 is, as can be seen in FIG. 1, joined to the stationary core 8 through a rubber packing or gasket 15 by crimping an open end of the yoke 2 inwardly.

Figure 2A:
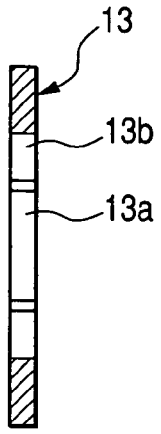
FIG. 2(*a*) is a longitudinal sectional view which shows a moving contact as used in the electromagnetic switch of FIG. 1.
Figure 2B:
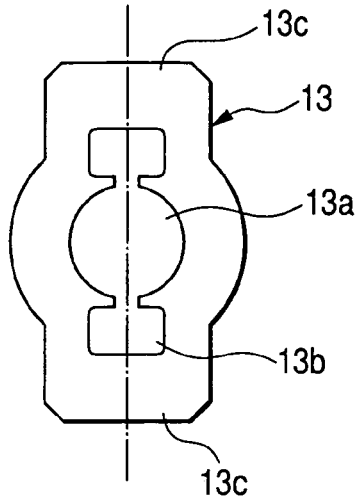

The moving contact 13 is, as illustrated in FIGS. 2(*a*) and 2(*b*), made of a rectangular metal plate such as a copper plate which has a substantially constant thickness. The moving contact 13 has a circular central hole 13*a* which is greater in diameter than the plunger shaft 7 and a pair of rectangular holes 13*b* formed across the central hole 13*a* in alignment with a longitudinal center line thereof. The moving contact 13 is retained by the end of the plunger shaft 7 through an insulator 16 and urged by a contact pressure spring 17 disposed between the flange 7*a* and the insulator 16 into abutment with a stopper 18 fitted in the end of the plunger shaft 7. The moving contact 13 has contact areas 13*c* formed outside the rectangular holes 13*b* in the lengthwise direction thereof and is held in an outer periphery thereof by an inner wall of the contact cover 14 from rotating in an effort to ensure the stability in establishing physical contacts of the contact areas 13*c* with the fixed contacts 12.

Figure 3A:
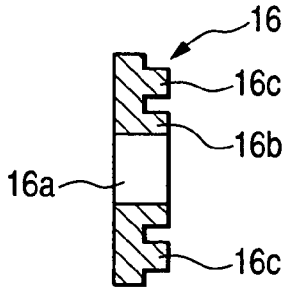
FIG. 3(*a*) is a longitudinal sectional view which shows an insulator as used in the electromagnetic switch of FIG. 1.
Figure 3B:
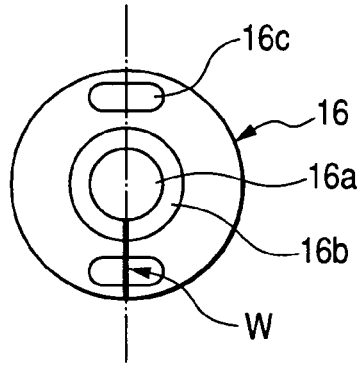

The insulator 16 is, as clearly illustrated in FIGS. 3(*a*) and 3(*b*), made of a disc which has a circular central hole 16*a* fitted on the periphery of the plunger shaft 7. The insulator 16 also has a cylindrical boss 16*b* formed around the central hole 16*a* and a pair of oval protrusions 16*c* arrayed outside the boss 16*b* in a radius direction thereof. The boss 16*b* and the protrusions 16*c*, as can be seen from FIG. 3(*a*), project from the same face of the insulator 16 to have a height, as clearly illustrated in FIG. 4(*a*), substantially equal to the thickness of the moving contact 13.

Figure 4A:
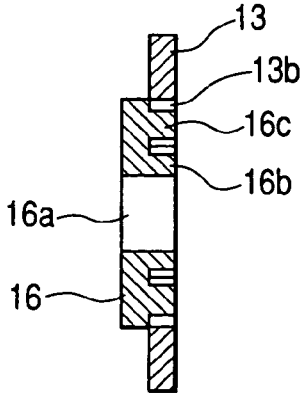
FIG. 4(*a*) is a longitudinal sectional view which shows an assembly of the moving contact and the insulator as illustrated in FIGS. 2(*a*) to 3(*b*)
Figure 4B:
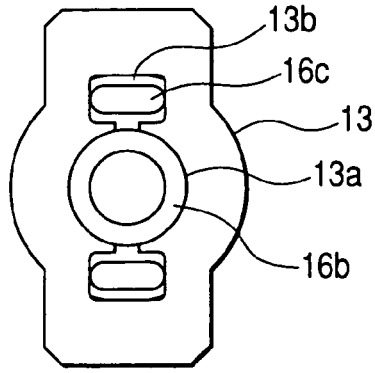

The moving contact 13 and the insulator 16 are, as shown in FIGS. 4(*a*) and 4(*b*), connected to each other. Specifically, the cylindrical boss 16*b* of the insulator 16 is fitted in the central hole 13*a* of the moving contact 13. Similarly, the protrusions 16*c* of the insulator 16 are also fitted in the rectangular holes 13*b* of the moving contact 13. This holds the insulator 16 and the moving contact 13 from rotating relative to each other.

In operation, when it is required to close the electromagnetic switch 1, the exciting coil 4 is energized to magnetize the stationary core 8. This will cause a magnetic attraction to be produced between the stationary core 8 and the plunger 6, so that the plunger 6 is moved toward the stationary core 8 (i.e., the right direction, as viewed in FIG. 1) against the spring pressure of the return spring 9. The contact areas 13*c* of the moving contact 13 then abut the fixed contacts 12 to establish the electric communication between the fixed contacts 12.

When it is required to open the electromagnetic switch 1, the exciting coil 4 is deenergized. This results in disappearance of the magnetic attraction, so that the plunger 6 is returned back to the initial position (i.e., the open position) thereof by the spring pressure of the return spring 9 to moving the moving contact 13 away from the fixed contacts 12.

The insulator 16 is, as described above, joined fixedly to the moving contact 13 through the fitting of the protrusions 16 in the rectangular holes 13*b* of the moving contact 13 to hold the insulator 16 from rotating relative to the moving contact 13. This eliminates relative frictional motion between the insulator 16 and the moving contact 13 in a circumferential direction of the switch 1, for example, when the vehicle is vibrating, thereby minimizing the wear of the insulator 16. This eliminates the need for a friction margin of the insulator 165 and allows the insulator 16 to be reduced in thickness, thus permitting the electromagnetic switch 1 to be decreased in overall length thereof.

The electromagnetic switch 1 according to the second embodiment will be described below.

The insulator 16, as used in this embodiment, is made of a resin mold. The moving contact 13 is, like the first embodiment, held by the inner periphery of the contact cover 14 from rotating and allowed to move in the axial direction of the plunger shaft 7, so that the moving contact 13 always hits at the same areas (i.e., the contact areas 13*c* in FIG. 2(*b*)) on the fixed contacts 12.

When the moving contact 13 is moved by the magnetic attraction acting on the plunger 6 and hits the fixed contacts 12, it will cause a physical impact to act on the insulator 16 through the moving contact 13. Since the moving contact 13 always hits at the same areas on the fixed contacts 12 and is held from rotating relative to the insulator 16, a maximum impact load is always exerted on the same potion of the insulator 16. Specifically, when the moving contact 13 hits the fixed contacts 12, the insulator 16 undergoes the impact load on the boss 16*b* and the protrusions 16*c* located outside the boss 16*b* in the radius direction thereof. The greatest impact, therefore, acts on right and left portions of the boss 16*b*, as viewed in FIG. 3(*b*).

In the case where the insulator 16 is made of a resin mold, it will be essential to design the location of a weld W, which is usually formed during molding of the insulator 16, in terms of the mechanical strength. Specifically, in the case where the greatest impact load acts on the weld W of the insulator 16 which is weakest in strength, it is necessary for the weld W to have the strength great enough to withstand the load, thus requiring the need for increasing the thickness of the insulator 16. This problem is, however, eliminated by forming the weld W at a location other than an area of the insulator 16 on which the greatest load acts.

Therefore, the insulator 16 of the second embodiment is so designed as to have the weld W, as illustrated in FIG. 3(*b*), formed at a location other than the right and left portions of the boss 16*b* on which the greatest load will act. It is advisable that the weld W, as demonstrated in FIG. 3(*b*), be formed so that it appears in an area of the insulator 16 which is occupied by either of the protrusions 16*c* subjected to the smallest impact load. This permits the insulator 16 to be reduced in thickness and, thus, the overall length of the switch 1 to be shortened. When formed in one of the protrusions 16*c*, the weld W will have the greatest thickness, thus resulting in an increased strength thereof. This permits the insulator 16 to be reduced in thickness as a whole.

The moving contact 13 is, as described above, of a rectangular shape, but however, it may have any other shape as long as it may retain the moving contact 13 on the inner periphery of the contact cover 14 without rotating relative to the contact cover 14. For instance, the moving contact 13 may be of a circular shape. This is achieved by holding the insulator 16 from turning relative to the shaft 7 and also holding the plunger 6 from turning. The latter may be accomplished by forming both the plunger 6 and the sleeve 5 into an oval shape in cross section so that the sleeve 5 holds therein the plunger 6 from turning.

The insulator 16 is, as described above, made of resin, but may alternatively be made of an electrically insulating material such as cork ceramic, or wood or a conductive material coated with an insulating film.

Figure 5:
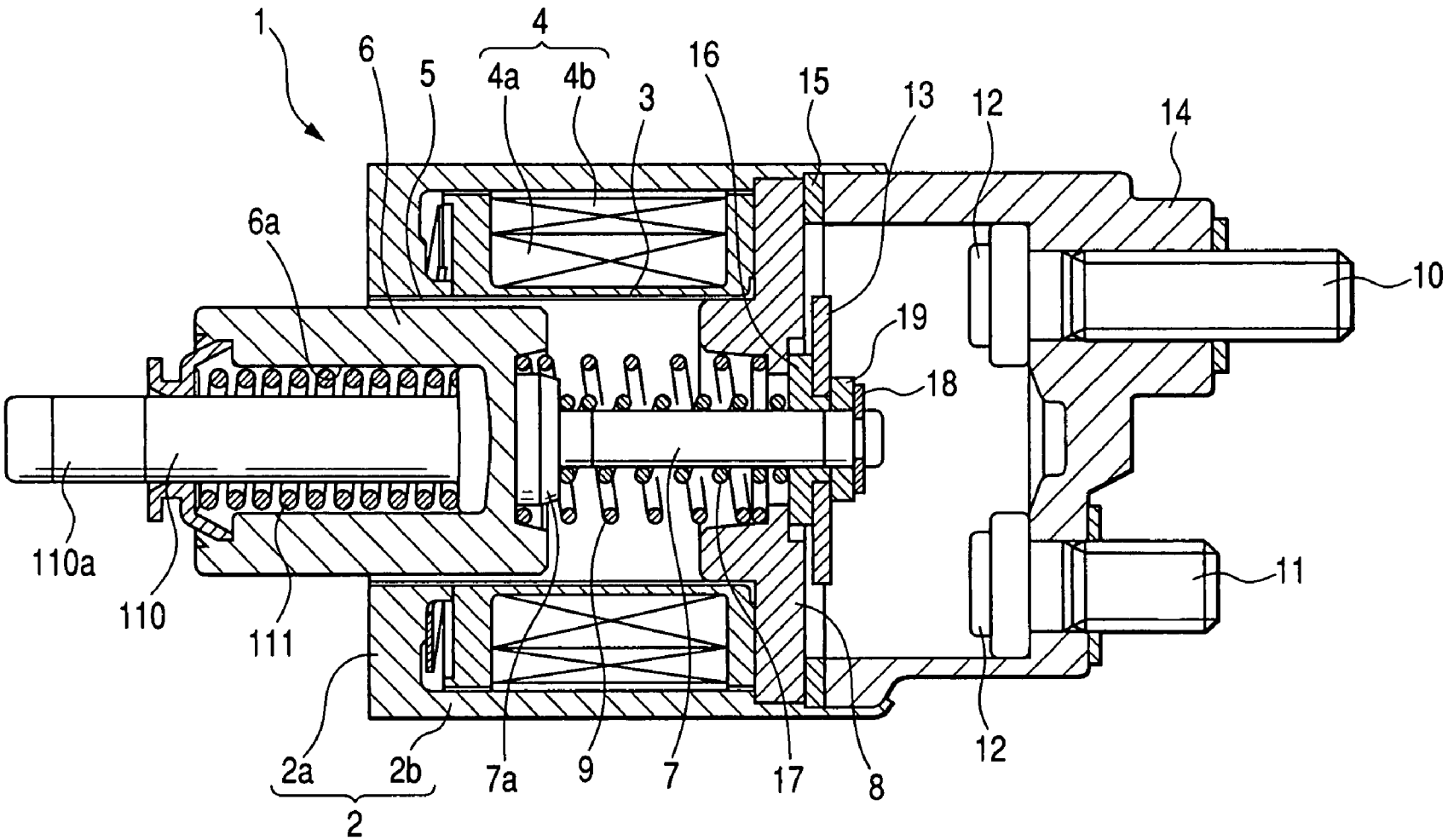
FIG. 5 is a longitudinal sectional view which shows an electromagnetic switch for a starter according to the third embodiment of the invention.

FIG. 5 shows the electromagnetic switch 1 according to the third embodiment of the invention. The same reference numbers as employed in the first to second embodiments refer to the same parts, and explanation thereof in detail will be omitted here.

The electromagnetic switch 1, like the first embodiment, includes general the cup-shaped yoke 2, the exciting coil 4, the plunger 6, the plunger shaft 7, and the motor contact assembly. The exciting coil 4 is wound round the bobbin 3 and disposed inside the yoke 2. The plunger 6 is disposed inside the bobbin 3 through the sleeve 5. The plunger shaft 7 is fixed to the plunger 6. The motor contact assembly works to open or close a motor circuit of a starter.

The yoke 2 also serves as an outer shell or a body of the electromagnetic switch 1 and also makes a magnetic circuit around the exciting coil 4 along with the stationary core 8. The stationary core 8 is made of an annular member having a center boss in which a central opening is formed and fit in an opening of the yoke 2 to retain the exciting coil 4 between itself and the bottom wall 2*a* of the yoke 2. The stationary core 8 is fitted at the center boss thereof in the bobbin 3.

The plunger 6 is disposed inside the bobbin 3 through the sleeve 5. The plunger 6 is made of a hollow cylinder and has formed therein a cylindrical chamber 6*a* which opens at an end face opposite the stationary core 8 and into which a transmission rod 110 is inserted. The transmission rod 110 works to transmit movement of the plunger 6 to a shift lever (not shown) and has an end portion which extends outside the cylindrical chamber 6*a* and has formed therein an annular groove 110*a* in which the shift lever is fitted. The cylindrical chamber 6*a* also has a drive spring 111 extending around the transmission rod 110 to urge the end of the transmission rod 110 into constant abutment with the bottom wall of the cylindrical chamber 6*a*.

The terminal bolts 10 and 11 are installed fixedly in the resinous contact cover 14. The fixed contacts 12 are disposed inside the contact cover 14 and affixed to the terminal bolts 10 and 11, respectively. The terminal bolt 10 is to be connected to a battery installed in the automotive vehicle through a cable. The terminal bolt 11 is to be connected to a positive terminal brush (not shown) of a starter motor through a motor lead (not shown).

The moving contact 13 is retained by the plunger shaft 7 through the insulator 16 and the holder plate 19 and urged by the spring pressure of the contact pressure spring 17 into constant engagement with the stopper 18 fitted in the end of the plunger shaft 7.

The insulator 16 is made of a resin disc having a circular center opening formed therein through which the plunger shaft 7 passes. The insulator 16, as clearly illustrated in FIG. 6, has an annular boss 16*a* which projects in the thicknesswise direction of the insulator 16 and extends around the center opening. The moving contact 13 is fitted on the periphery of the annular boss 16*a*.

The holder plate 19 is fitted on the plunger shaft 7 in abutment with the end face of the moving contact 13 opposite the insulator 16 to hold the moving contact 13 fixedly on the plunger shaft 7 along with the insulator 16.

FIG. 5 illustrates the electromagnetic switch 1 before being installed at a given location in the starter for automotive vehicles. Specifically, the spring pressure exerted by the return spring 9 on the plunger 6 is absorbed by abutment of the insulator 16 with the stationary core 8. In other words, when the plunger 6 is returned away from the stationary core 8 by the spring pressure of the return spring 9, the insulator 16 works as a stopper to define a returned position of the plunger 6 (i.e., the open position of the switch 1).

Figure 6:
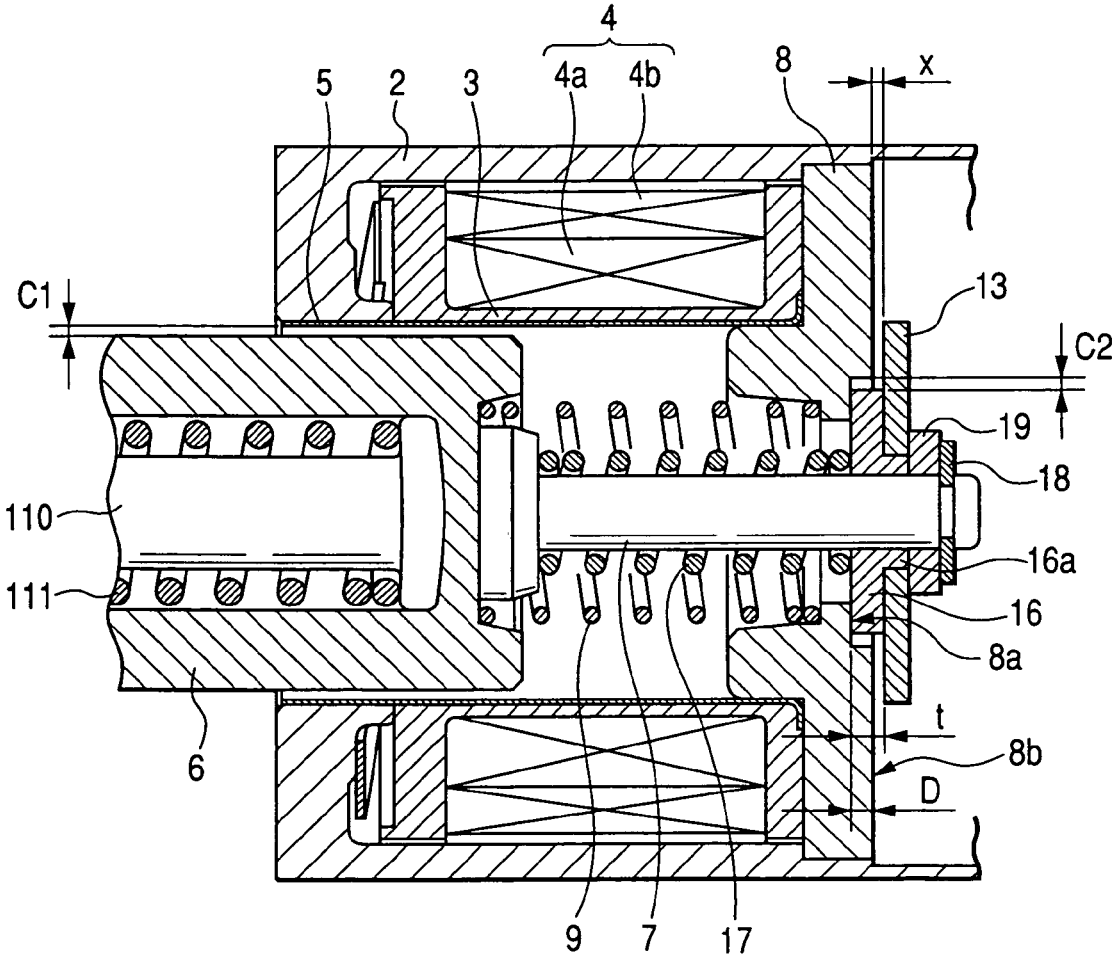
FIG. 6 is a partially enlarged view of FIG. 5.

The stationary core 8, as clearly illustrated in FIG. 6, has an annular recess formed in a central portion thereof. The recess has an annular bottom with a hitting face 8*a* on which the end surface of the insulator 16 hits when the plunger 6 is brought into the returned position. The stationary core 8 also has a step formed between the hitting face 8*a* and the end face 8*b* of the stationary core 8 oriented opposite the plunger 6. The hitting face 3*a* is lower in level than the end face 8*b*, as viewed in the thickness-wise direction of the stationary core 8.

The insulator 16, as can be seen from FIG. 6, has the thickness t except for the annular boss 16*a* which is greater than the thickness D of the step of the stationary core 8 (i.e., the distance between the hitting face 8*a* and the end face 8*b*). Therefore, when the insulator 16 hits the hitting face 8*a* of the stationary core 8, the gap X is formed between the moving contact 13 and the end face 8*b* of the stationary core 8, thus avoiding a direct hit of the moving contact 13 on the stationary core 8.

Specifically, the electromagnetic switch 1 is so designed that when the plunger 6 is returned by the return spring 9 back to the stationary core 8, the insulator 16 hits at the end surface thereof on the hitting face 8*a* of the stationary core 8 recessed deeper than the end face 8*b*. When the insulator 16 is brought into abutment with the hitting face 8*a* of the stationary core 8, the insulator 16 partially overlaps the stationary core 8 in the radius direction of the switch 1, that is, the insulator 16 partially enters the stationary core 8. This structure permits the insulator 16 to be increased in thickness t without the need for increasing the overall length of the switch 1. The increasing of the thickness t of the insulator 16 results in an increased mechanical strength of the insulator 16.

When the insulator 16 hits the hitting face 8*a* of the stationary core 8, the moving contact 13 is kept away from the end face 8*b* of the stationary core 8, thus permitting the moving contact 13 to be reduced in thickness. Specifically, it is unnecessary to have the moving contact 15 work as a stopper which hits the stationary core 8 when the plunger 6 is returned back to the open position (i.e., the leftward position, as viewed in FIG. 5) of the switch 1. This eliminates the need for the moving contact 13 to have the mechanical strength enough to withstand the returning force of the plunger 16, thus permitting the moving contact 13 to be decreased in thickness and weight.

The electromagnetic switch 1 according to the fourth embodiment will be described below.

The electromagnetic switch 1 is so designed that the clearance C1 between the plunger 6 and the sleeve 5 and the clearance C2 between the outer periphery of the insulator 16 and the inner wall of the recess of the stationary core 8 meet a relation of C1<C2. This prevents the insulator 16 from riding on the end face 8*b* of the stationary core 8 when the plunger 6 is shifted or inclined in the radius direction within the sleeve 5, thus ensuring the stability in returning the plunger 6 away from the stationary core 8.

Figure 7:
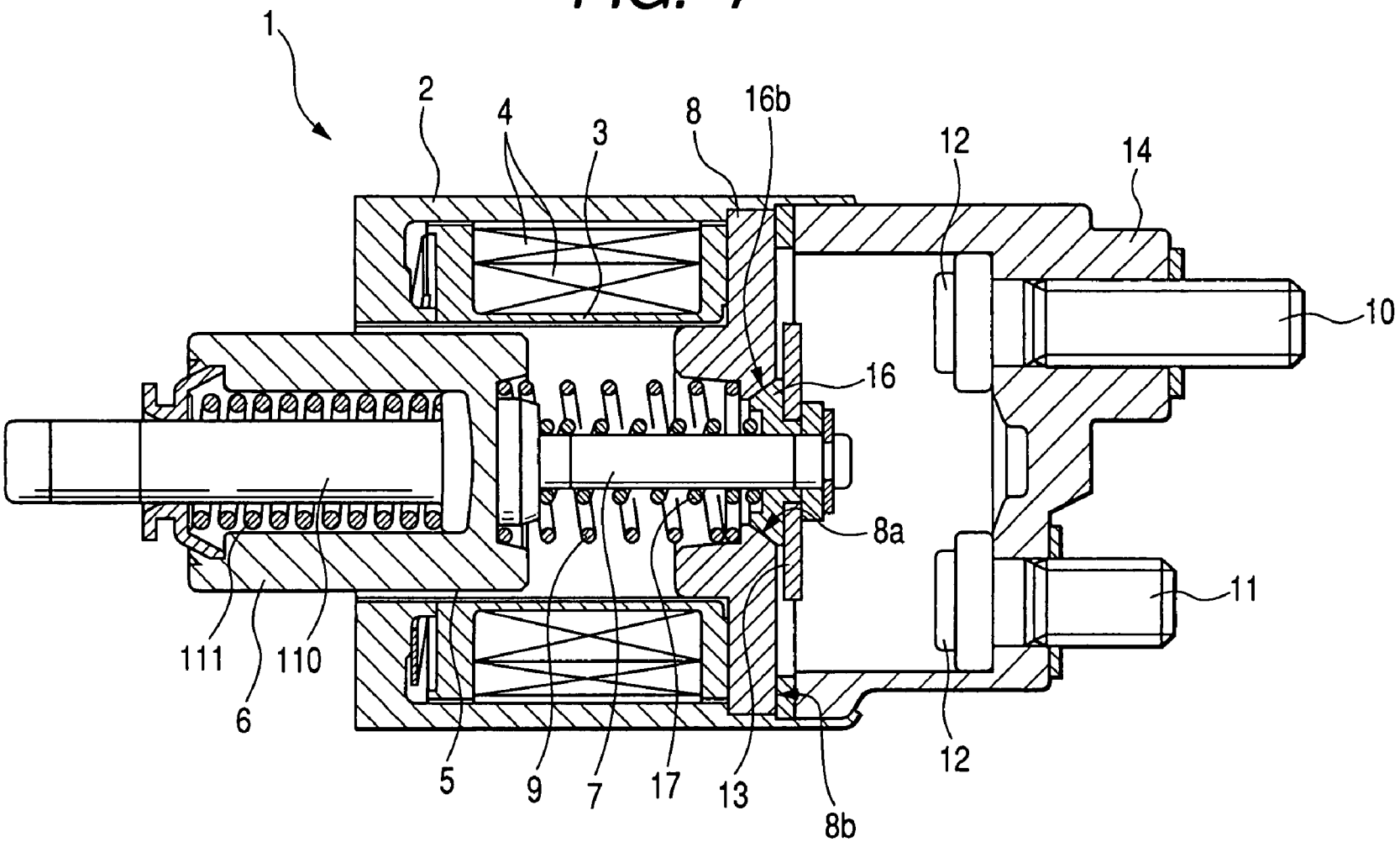
FIG. 7 is a longitudinal sectional view which shows an electromagnetic switch for a starter according to the fifth embodiment of the invention.

FIG. 7 shows the electromagnetic switch 1 according to the fifth embodiment of the invention.

The electromagnetic switch 1 is so designed that the stationary core 8 and the insulator 16 have the hitting face 8*a* and the outer side face 16*b* which taper to the plunger 6, respectively. Specifically, the hitting face 8*a* is defined by a conical inner wall continuing from the end face 8*b* of the stationary core 8. The outer side face 16*b* of the insulator 16 is contoured to conform with the hitting face 8*a* so that it is fitted in the hitting face 8*a* and works as a stopper to hold the plunger shaft 7 from moving after the insulator 16 hits the stationary core 8. The gap, like the third embodiment, will be established between the moving contact 13 and the end face 8*b* of the stationary core 8 upon hitting of the outer side face 16*b* of insulator 16 on the hitting face 8*a* of the stationary core 8 to avoid a direct hit of the moving contact 13 on the stationary core 8.

When the plunger 6 is returned away from the stationary core 8 by the activity of the return spring 9, the outer side face 16*b* of the insulator 16 is fitted on the hitting face 8*a* of the stationary core 8, so that insulator 16 partially overlaps the stationary core 8 in the radius direction of the switch 1, that is, the insulator 16 partially enters the stationary core 8. This structure its the insulator 16 to be increased in thickness without the need for increasing the overall length of the switch 1. The increasing of the thickness t of the insulator 16 results in an increased medical strength of the insulator 16.

The insulator 16 enters deeper into the stationary core 8 than the end face 8*b*, thereby resulting in an increased amount by which the plunger 6 protrudes from the yoke 2, which facilitates ease of instruction of the switch 1 in the starter. Additionally, the engagement of the tapered outer side face 16*b* of the insulator 16 with the tapered hitting face 8*a* of the stationary core 8 increases the accuracy in centering the plunger shaft 7, thereby ensuring the stability in assembling the switch 1 in the starter. The engagement also minimizes the inclination or deflection of the insulator 16 to avoid exertion of a undesirable biasing force on the insulator 16, thus permitting the mechanical strength of the insulator 16 to be selected to be minimum. This allows the insulator 16 to be made of an inexpensive material.

The moving contact 13 is kept away from the end face 8*b* of the stationary core 8 when the insulator 16 hits the stationary core 8, thus eliminating the need for the moving contact 13 to have the mechanical strength enough to withstand the returning force of the plunger 16, thus permitting the moving contact 13 to be decreased in thickness and weight.

Figure 8:
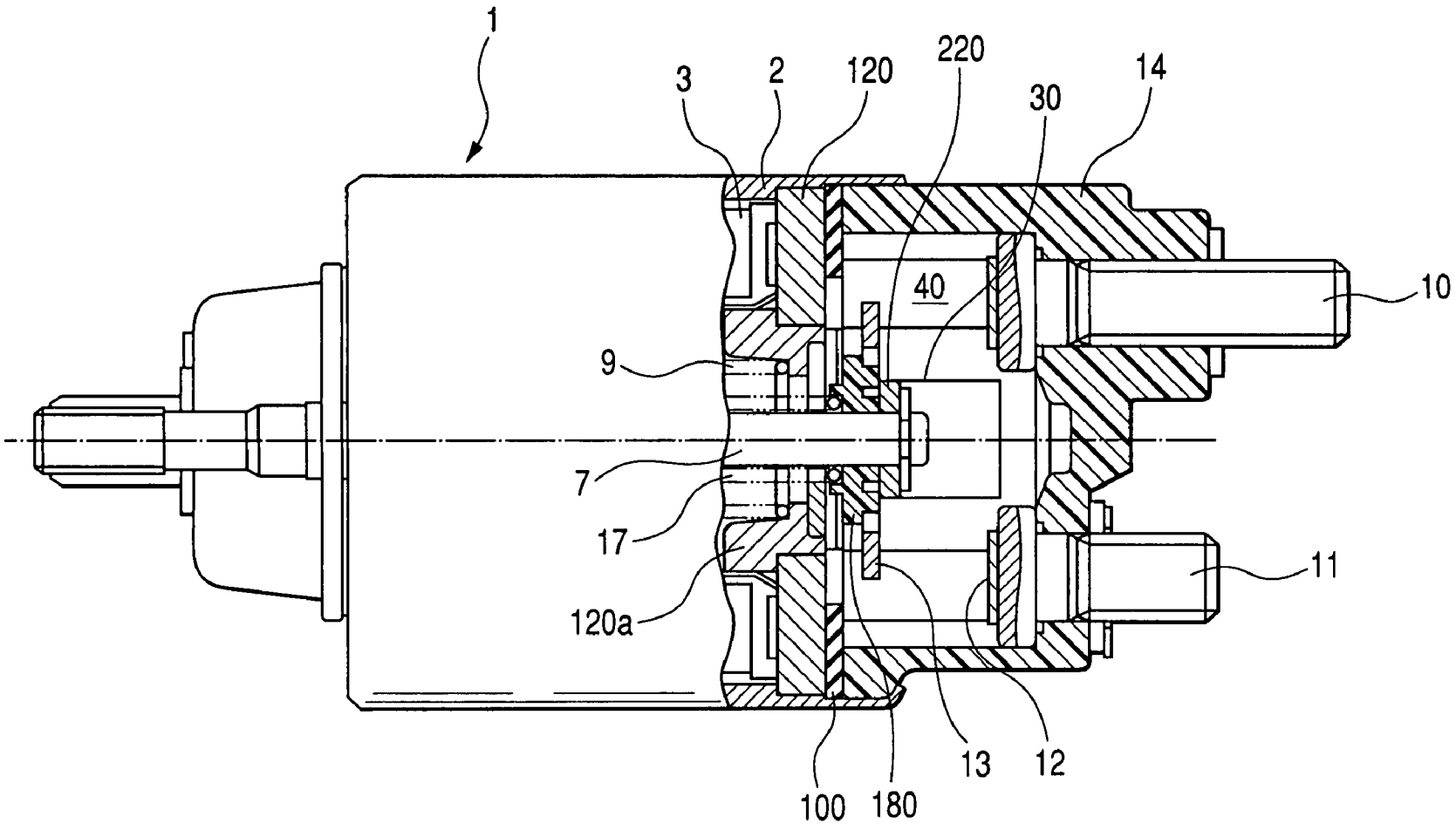
FIG. 8 is a partially longitudinal sectional view which shows an electromagnetic switch according to the sixth embodiment of the invention.

FIG. 8 shows the electromagnetic switch 1 according to the sixth embodiment of the invention. The same reference numbers as employed in the above embodiments refer to the same parts, and explanation thereof in detail will be omitted here.

The electromagnetic switch 1 is designed to establish or block the supply of electricity to an electric motor installed in a starter for automotive engines and also move a lever which drives a pinion. The electromagnetic switch 1 is substantially identical in structure and operation with typical lever-driving starter magnetic switch except for what is described below.

The contact cover 14 is, like the above embodiments, made of resin and has formed therein a contact chamber 40 within which the moving contact 13 is disposed to be movable in the axial direction of the switch 1. The contact cover 14 is joined to the yoke 2 through a stationary core 120 and a seal ring 100 by crimping the open end of the yoke 2 inwardly.

The yoke 2, like the above embodiments, serves as a switch body and works to make a magnetic circuit which consists of the yoke 2, the stationary core 120, the sub-stationary core 120*a*, and an iron-made plunger (i.e., the plunger 6 in FIG. 1) jointed to the plunger shaft 7.

The plunger shaft 7 extends through the stationary core 120 into the contact chamber 40. The plunger shaft 7 has a bush 180 fitted to be slidable thereon. The moving contact 13 is fitted on the bush 180 and extends in the radius direction of the plunger shaft 7. The moving contact 13 is urged directly by the contact pressure spring 17 against a circlip 30 (also called C-shaped clip or snap ring) through a washer 220. The circlip 30 is fitted in an annular groove formed in the end of the plunger shaft 7 to retain the washer 220 in abutment with the bush 180.

The seal ring 100 is fitted in the rear open end of the yoke 2. The contact cover 14 is also fitted in the rear open end of the yoke 2 in abutment with the seal ring 100 and joined to the yoke 2 by crimping the open end of the yoke 2 inwardly. The seal ring 100 is made of rubber and elastically nipped between the rear end of the stationary core 120 and the front end of the contact cover 14 to seal the contact chamber 40 hermetically.

Figure 9B:
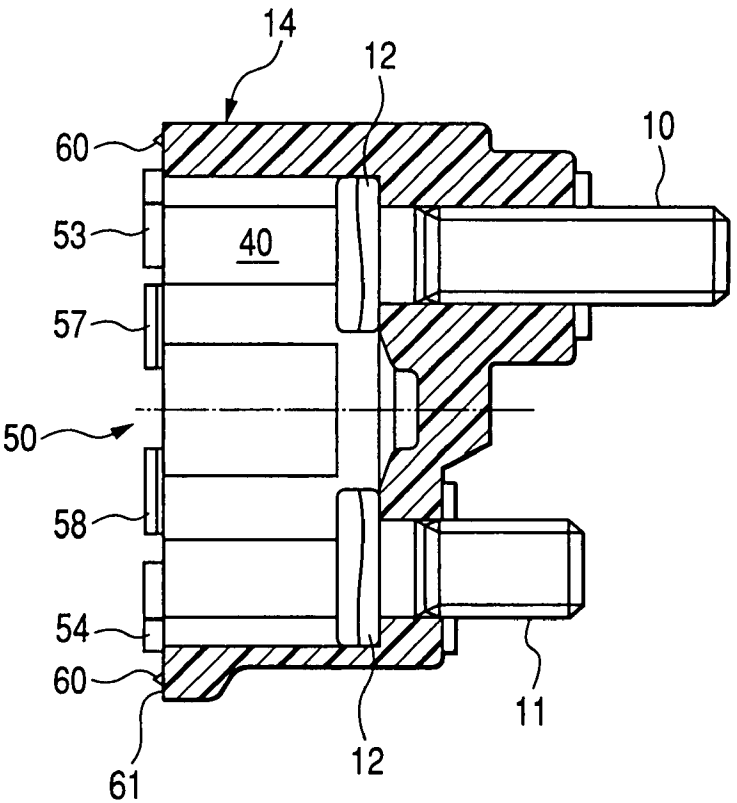
FIG. 9(*a*) is a front view which shows a contact cover as used in the electromagnetic switch of FIG. 8.
Figure 9A:
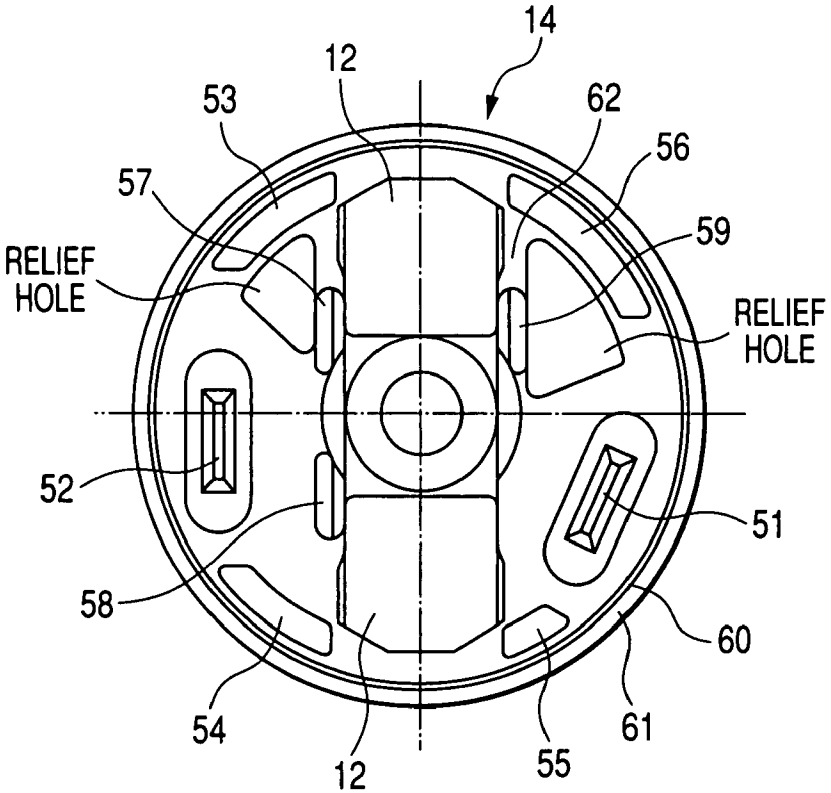
Figure 11:
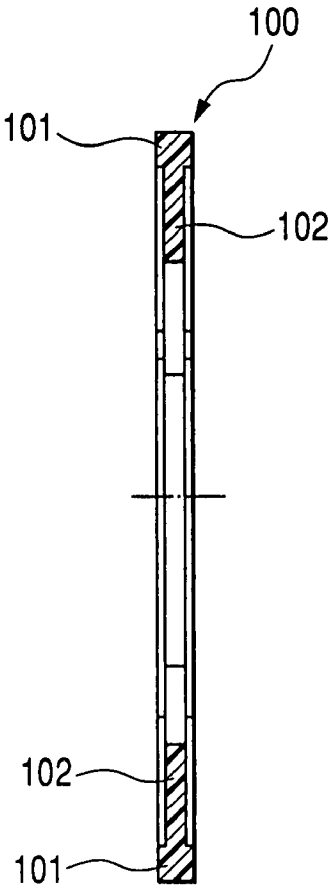
FIG. 11 is a sectional view as taken along the line A-A in FIG. 10.
Figure 10:
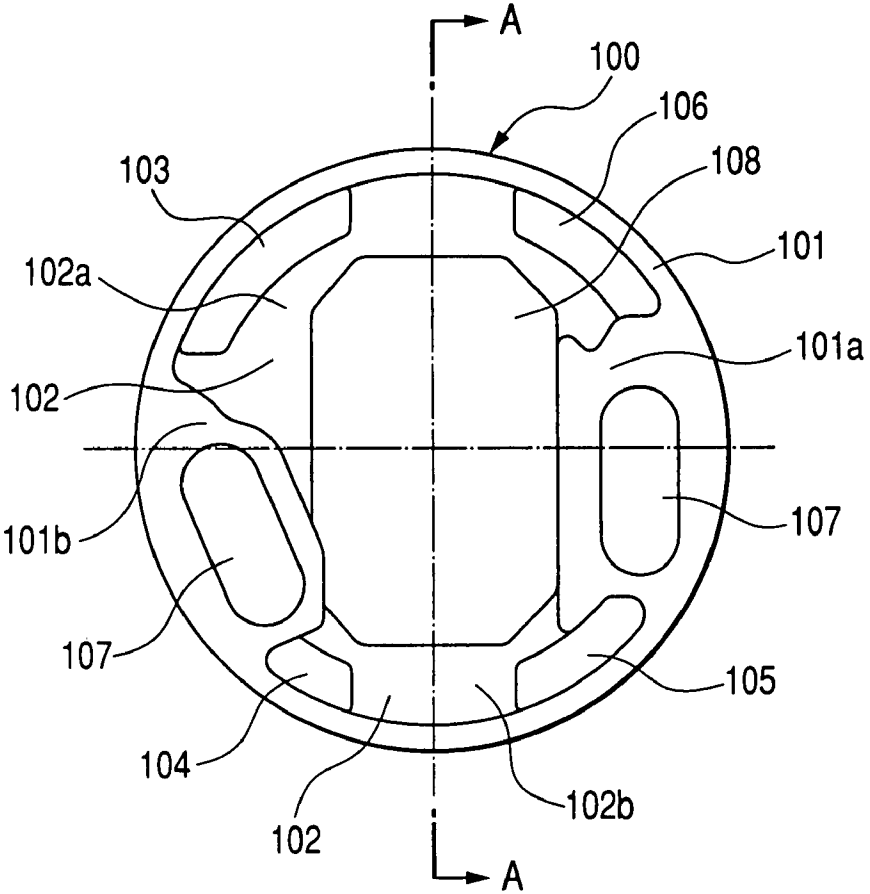
FIG. 10 is a front view which shows a seal ring as used in the electromagnetic switch of FIG. 8.

The structures of the contact cover 14 and the seal ring 100 will be described in detail with reference to FIGS. 9(*a*) toll. FIG. 9(*a*) is a front view which shows the front end of the contact cover 14. FIG. 9(*b*) is a longitudinal sectional view of FIG. 9(*a*). FIG. 10 is a front view which shows the seal ring 100. FIG. 11 is a sectional view, as taken along the line A-A in FIG. 10.

The contact cover 14, as clearly illustrated in FIGS. 9(*a*) and 9(*b*), has formed in the central portion of the front end 50 a recess which extends in a radius direction of the contact cover 14 and defines the contact chamber 40. The contact cover 14 also has a pair of terminal holes 51 and 52 which are formed across the contact chamber 40 and through which terminals of coils are to pass for supply power to the exciting coil 4 (see FIG. 1) and a total of seven protrusions 53 to 59 which are to be placed in abutment with the stationary core 120. The terminal holes 51 and 52 are made of slits each of which is surrounded by a tapered rectangular wall and an oval recess. The front end 50 of the contact cover 14 has annular outside edges 60 and 61 and an inside end face 58. The outside edge 61 is an annular flat face defining the circumference of the front end 50. The outside edge 60 is an annular ridge which is, as can be seen from FIG. 9(*b*), of a triangular cross section projecting from the outside edge 61 in the axial direction of the contact cover 14. The annular outside edges 60 and 61 are to be urged into constant abutment with the seal ring 100 in the axial direction of the switch 1. The inside end face 62 is to face the seal ring 100 and hardly press the seal ring 100 in the axial direction of the switch 1. The inside end face 62 occupies a portion of the front end 50 which is located inside the annular edge 60 and extends around the terminal holes 51 and 52 and the protrusions 53 to 59.

The seal ring 100 is made up of an annular outside thick wall 101 and an inside thin wall 102. The annular thick wall 101 is to be nipped between the annular outside edges 60 and 61 of the contact cover 14 and the rear end surface of the stationary core 120. The inside thin wall 102 extends inside the annular thick wall 101 and is to be nipped between the inside end face 62 of the contact cover 14 and the rear end surface of the stationary core 120. The inside thin wall 102 is, as clearly illustrated in FIG. 11, recessed from ends of the annular thick wall 101.

Specifically, when the contact cover 14 is joined to the yoke 2, the annular outside edges 60 and 61 of the contact cover 14 work to compress the annular outside thick wall 101 of the seal ring 100 to make a hermetical seal. The inside end face 62 of the contact cover 14 is to be placed in abutment with the inside thin wall 102 of the seal ring 100 without compressing the annular outside thick wall 101 of the seal ring 100 to hermetically seal the contact chamber 40 and the terminal holes 51 and 52.

The inside thin wall 102 is, as can be seen from FIG. 10, consists essentially of two sections: upper and lower arc-shaped ones 102*a* and 102*b*, as viewed in the drawing, each of which connects between two inwardly extending areas 101*a* and 101*b* of the annular outside thick wall 101 for surrounding the terminal holes 51 and 52 of the contact cover 14. The areas 101*a* and 101*b* have formed therein oval windows 107 which face the terminal holes 51 and 52 when the contact cover 14 is affixed to the seal ring 100 so that power supply leads extend from the terminal holes 51 and 52 through the windows 107 and connect with the exciting coil 4, as illustrated in FIG. 1. The seal ring 100 also has positioning holes 103, 104, 105, and 106 through which the protrusions 53 to 56 of the contact cover 14 are to pass and abut the rear end surface of the stationary core 120.

When the contact cover 14 is joined to the yoke 2, the four protrusions 53 to 56 of the contact cover 14 are fitted in the positioning holes 103 to 106 of the seal ring 100 in abutment with the rear end surface of the stationary core 120. The protrusions 57 to 59 are fitted inside the contact chamber window 108 in contact with an inner edge thereof to position the moving contact 13 within the contact cover 14. The positioning holes 103 to 106 are defined or surrounded by the annular outside thick wall 101 and the inside think wall 102.

In operation of the electromagnetic switch 1, when an ignition switch (not shown) of the automobile is turned on to energize the exciting coil 4, as illustrated in FIG. 1, it will cause the plunger 6 to be attracted to push the plunger shaft 7 together with the moving contact 13 against the spring pressure of the return spring 9 from the switch open position, as illustrated in FIG. 8, to the switch closed position. When reaching the switch closed position, the moving contact 13 hit the fixed contacts 12 affixed to the terminal bolts 10 and 11. The plunger 6 is further attracted against the spring pressure of the return spring 9 until it abuts the front end surface of the sub-stationary core 120*a* and then stops. The contact pressure spring 17 works to exert the spring pressure on the moving contact 13 to ensure the abutment with the fixed contacts 12, thereby supplying the electricity from the battery to the starter motor. When the exciting coil 4 is deenergized to cause the magnetic attraction to disappear after the engine has started, the return spring 9 returns the plunger 6 toward the open position of the switch 1 to move the moving contact 13 away from the fixed contacts 12.

When the contact cover 14 is joined to the yoke 2, the inside thin wall 102 of the seal ring 100 is disposed between the inside end face 62 of the contact cover 14 and the rear end surface of the stationary core 120. The inside thin wall 102 is smaller in thickness than the outside thick wall 101, so that the thickness thereof is compressed to a smaller extent than the outside thick wall 101 upon the joining of the contact cover 14 to the yoke 2. This permits the degree of pressure, which is required to press the contact cover 14 against the stationary core 120 when the open end of the yoke 2 is crimped to make a firm joint of the contact cover 14 to the yoke 2, to be reduced without sacrificing the ability of sealing of the seal ring 100. The inside thin wall 102 is made of packing sheets connecting with the inwardly extending areas 101*a* and 101*b* of the annular outside thick wall 101, thus mining undesirable deformation of the seal ring 100 when installed in the yoke 2 to facilitate the ease of the installation thereof.

The inside thin wall 102 is, as described above, made up of the sections 102*a* and 102*b* which are curved and connect with the inwardly extending areas 101*a* and 101*b* of the annular outside thick wall 101, thus resulting in a decrease in total amount of material of the seal ring 100, which enhances the above described effects.

The sections 102*a* and 102*b* are curved inwardly and extend along the entire circumference of the seal ring 100 together with the inwardly extending areas 101*a* and 101*b* of the annular outside thick wall 101, thus enhancing the resistance to deformation of the seal ring 100.

The seal ring 100 is, as described above, designed to decrease the thickness of the inside thin wall 102 in order to reduce the pressure required to press the contact cover 14 against the stationary core 120 when the open end of the yoke 2 is crimped to make the firm joint of the contact cover 14 to the yoke 2, but however, a portion of the front end 50 of the other than an area abutting the annual outside thick wall 101 of the seal ring 100 and the protrusions 53 to 56, that is, the inside end face 62 may alternatively be recessed to decrease the thickness thereof by an amount equivalent to a difference in thickness between the annular outside thick wall 101 and the inside thin wall 102. This structure also offers the above described advantage.

Figure 12:
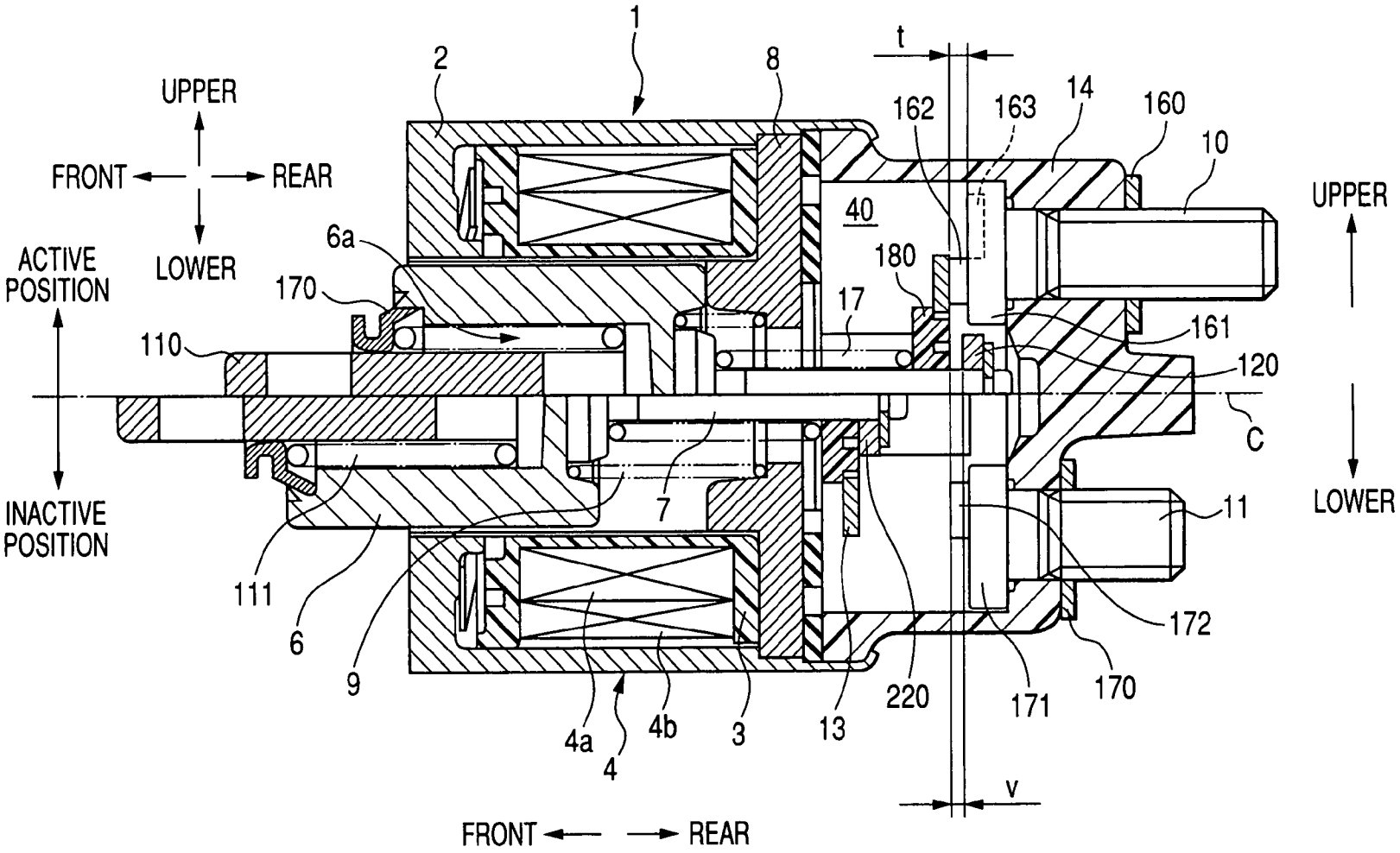
FIG. 12 is a longitudinal sectional view which shows an electromagnetic switch for a starter according to the seventh embodiment of the invention.

FIG. 12 shows the electromagnetic switch 1 according to the seventh embodiment of the invention. The same reference numbers as employed in the above embodiment refer to the same parts, and explanation thereof in detail will be omitted here.

The plunger 6, like the third embodiment, has formed therein the cylindrical chamber 6*a* within which the drive spring 111 extends around the transmission rod 110. The drive spring 111 rests at an end thereof on a collar 170 fitted in an open end of the plunger 6 and at the other end on a bottom flange of the transmission rod 110 to urge the bottom flange of the transmission rod 110 into constant abutment with the bottom wall of the cylindrical chamber 6*a*.

Figure 13A:
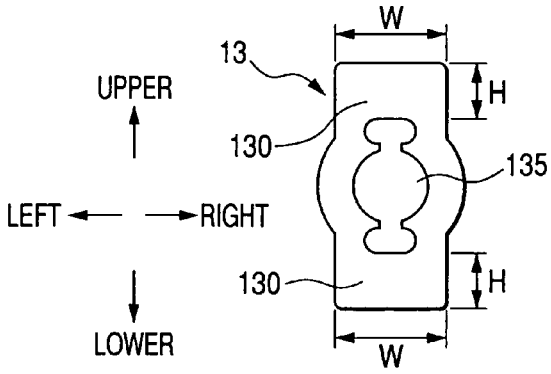
FIG. 13(*a*) is a font view which shows a moving contact used in the electromagnetic switch of FIG. 12.
Figure 13B:
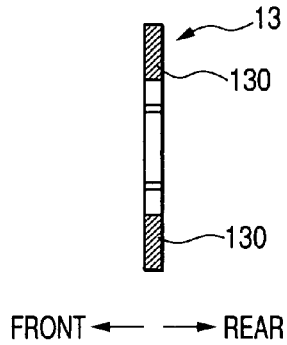

The moving contact 13 is, as illustrated in FIGS. 13(*a*) and 13(*b*), made of a rectangular conductive plate which has formed in a central portion thereof an opening 135 into which the plunger shaft 7 is to be inserted. The moving contact 13 is, as illustrated in FIG. 12, oriented within the contact cover 14 so as to have the length extending vertically in the drawing. The moving contact 13 has contact areas 130 defined outside the hole 135 in the lengthwise direction thereof. Each of the contact areas 130 is of a rectangular shape having the width W and the height H.

The terminal bolts 10 and 11 are fitted in holes formed in the bottom end of the resinous contact cover 14 and retained fixedly by nuts 160 and 170. The terminal bolts 10 and 11 have heads 161 and 171 exposed to the contact chamber 40. The heads 161 and 171 are arrayed vertically, as viewed in FIG. 12, at equi-distances from the longitudinal center line C of the plunger shaft 7 (i.e., the switch 1.

Figure 14A:
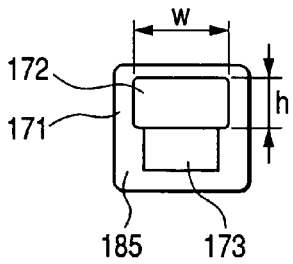
FIG. 14(*a*) is a front view which shows a terminal bolt installed in the electromagnetic switch of FIG. 12.
Figure 14B:
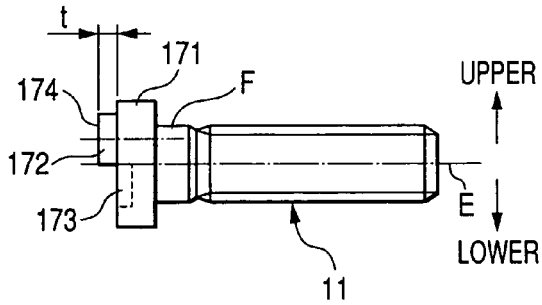

The heads 161 and 171 have formed top ends thereof protrusions 162 and 172 serving as fixed contacts. The fixed contact 162 is located closer to the plunger shaft 7 than the longitudinal center line of the terminal bolt 10. Similarly, the fixed contact 172 is located closer to the plunger shaft 7 than the longitudinal center line of the terminal bolt 11. Specifically, as illustrated in FIGS. 14(*a*) and 14(*b*), the axial line F (i.e., the center) of the fixed contact 172 is shifted closer to the plunger shaft 7 than the longitudinal center line E of the terminal bolt 11. Preferably, the whole of the fixed contact 172 of the terminal bolt 11 is shifted from the longitudinal center line E of the terminal bolt 11 toward the plunger shaft 7 (i.e., the upper side in FIG. 12). Similarly, the axial line (i.e., the center) of the fixed contact 162 is shifted closer to the plunger shaft 7 than the longitudinal center line of the terminal bolt 10. Preferably, the whole of the fixed contact 162 of the terminal bolt 10 is shifted from the longitudinal center line of the terminal bolt 10 toward the plunger shaft 7 (i.e., the lower side in FIG. 12).

The head 171 of the terminal bolt 11, as clearly illustrated in FIGS. 12, 14(*a*), and 14(*b*), has formed therein a rectangular recess 173 which is located farther from the longitudinal center line C of the plunger shaft 7 than the fixed contact 172. Similarly, the head 161 of the terminal bolt 10, as clearly illustrated in FIG. 12, has formed therein a rectangular recess 163 which is located farther from the longitudinal center line C of the plunger shaft 7 than the fixed contact 162. Each of the fixed contacts 162 and 172 is, as shown in FIGS. 14(*a*) and 14(*b*), of a rectangular shape having the width w, the height h, and the thickness t. The height h is slightly smaller than the height H of the moving contact 13. The width w is slightly smaller than the width W of the moving contact 13. This ensures contact of entire surfaces (i.e., 174 in FIG. 14(*b*)) of the fixed contacts 162 and 172 with the moving contact 13. The thickness t of each of the fixed contacts 162 and 172 is selected, as shown in FIG. 12, to be greater than the interval V between the front end surface of the washer 220 and the rear end surface of the bush 180 (i.e., an available additional amount of expansion of the contact pressure spring 17) by a given value when the moving contact 13 is placed in abutment with the fixed contacts 162 and 172. This ensues physical abutment of the contact areas 130 of the moving contact 13 with the fixed contacts 162 and 172 within a range of a maximum possible amount of wear of the fixed contacts 162 and 172 without hitting areas 185, as illustrated in FIG. 14(*a*), of the end surfaces of the heads 161 and 171 other than the fixed contacts 162 and 172.

The structure of the electromagnetic switch 1 offers advantages below.

Figure 15:
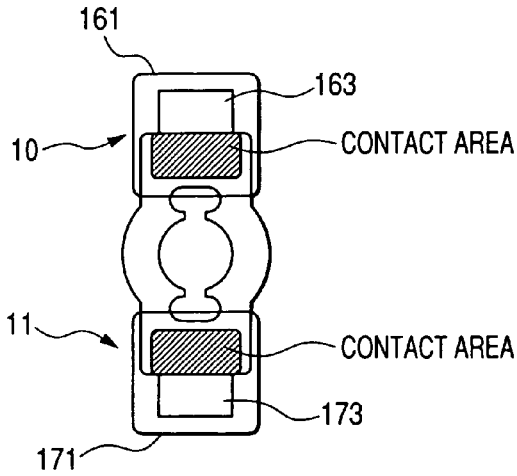
FIG. 15 is a front view which shows a moving contact when abutting terminal bolts in the electromagnetic switch of FIG. 12.

The terminal bolts 10 and 11 have the protrusions or fixed contacts 162 and 172 biased toward the axis of the plunger shaft 7 connected to the plunger 6, thus permitting the length of the moving contact 13 (i.e., the vertical distance between the ends of the moving contact 13, as viewed in FIG. 12) to be decreased and ensuring the contacts, as illustrated by hatched areas in FIG. 15, of the entire surfaces of the fixed contacts 162 and 172 with the moving contact 13 without need for decreasing the interval between the terminal bolts 10 and 11. This avoids a direct hit of the washer 220 installed on the end of the shaft 2 on the terminal bolts 10 and 11.

The surfaces of the fixed contacts 162 and 172 of the terminal bolts 10 and 11 and the surface of the moving contact 13 which are to make contacts are designed to be rectangular, thus permitting the length of the moving contact 13 to be decreased without sacrificing areas of contacts between the moving contact 13 and the fixed contacts 162 and 172. The decrease in length of the moving contact 13 results in a reduction in eccentric load on the moving contact 13, as produced when the moving contact 13 is inclined due to the play between the moving contact 13 and the plunger shaft 7, which minimizes local wear of the surfaces of the fixed contacts 162 and 172. The formation of the recesses 163 and 173 next to the fixed contacts 162 and 172 on the heads 161 and 171 of the terminal bolts 10 and 11 results in a decrease in amount of condensed or frozen moisture to be adhered to the surfaces of the fixed contacts 162 and 172 when the ambient temperature drops. The recesses 163 and 173 may be formed to have uneven surfaces to increase areas thereof or alternatively be replaced by irregularities formed on the heads 161 and 171.

The major bodies of the terminal bolts 10 and 11, the fixed contacts 162 and 172, and the heads 161 and 171 are made of the same conductive material, but however, portions of the terminal bolts 10 and 11 (including the heads 161 and 171) other than the fixed contacts 162 and 172 may be made of a material lower in thermal conductivity than that of the fixed contacts 162 and 172. This causes the rate at which the temperature of the terminal bolts 10 and 11 (including the heads 161 and 171) drops to be lower than that of the fixed contacts 162 and 172. Therefore, when the outside temperature drops, for example, the amount of thermal energy drawn from the fixed contacts 162 and 172 to cables joined to the terminal bolts 10 and 11 will decrease, thus resulting in a decrease in amount of condensed or frozen moisture sticking to the surfaces of the fixed contacts 162 and 172.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. An electromagnetic switch comprising:

a plunger to be attracted through electromagnetic force;

fixed contacts to be joined to a motor circuit of a starter;

a moving contact working to establish electric communication between said fixed contacts;

a plunger shaft which retains said moving contact through an insulator, said plunger working to move said moving contact following magnetic attraction of said plunger to bring said moving contact into abutment with said fixed contacts to establish the electric communication therebetween; and a rotation holder disposed between said moving contact and said insulator, said rotation holder working to hold said moving contact and the insulator from rotating relative to each other, wherein said moving contact is so retained that said moving contact hits at substantially the same areas thereof with said fixed contacts, and wherein the insulator is made of a resin mold in which a weld is formed in a location other than a portion of the insulator on which a maximum impact load acts when said plunger is magnetically attracted to bring said moving contact into abutment with said fixed contacts.

2. An electromagnetic switch as set forth in claim 1, wherein the weld is formed in the portion of the insulator on which a minimum impact load acts when said plunger is magnetically attracted to bring said moving contact into abutment with said fixed contacts.

3. An electromagnetic switch as set forth in claim 1, further comprising a contact cover which covers said fixed contacts and the moving contact, and wherein said moving contact is held at an outer periphery thereof by an inner wall of said contact cover from rotating and movable in an axial direction of said contact cover.

4. An electromagnetic switch as set forth in claim 1, wherein said rotation holder is made up of a recess formed in said moving contact and a protrusion formed on the insulator which is fitted in the recess to hold said moving contact and the insulator from rotating relative to each other.

5. An electromagnetic switch comprising:

a plunger to be attracted through electromagnetic force;

fixed contacts to be joined to a motor circuit of a starter:

a moving contact working to establish electric communication between said fixed contacts;

a plunger shaft which retains said moving contact through an insulator, said plunger working to move said moving contact following magnetic attraction of said plunger to bring said moving contact into abutment with said fixed contacts to establish the electric communication therebetween; and a rotation holder disposed between said moving contact and said insulator, said rotation holder working to hold said moving contact and the insulator from rotating relative to each other, wherein the insulator is made of a resin mold in which a weld is formed, and wherein said rotation holder is made up of a recess formed in said moving contact and a protrusion formed on the insulator which is fitted in the recess to hold said moving contact and the insulator from rotating relative to each other, the weld being formed so as to appear in the protrusion.

* * * * *